US005300024A

United States Patent [19]

Yang

[11] Patent Number: 5,300,024

[45] Date of Patent: Apr. 5, 1994

[54] BI-FUNCTIONAL COMFORT NIPPLE

[76] Inventor: Ming-Tung Yang, No. 4-3, Lane 97, Lung Chuen Street, Taipei Hsien, Taiwan

[21] Appl. No.: 960,802

[22] Filed: Oct. 14, 1992

[51] Int. Cl.[5] ..... A61J 7/00

[52] U.S. Cl. ..... 604/73; 606/234

[58] Field of Search ..... 606/234, 235, 236; 222/192, 490, 205; 215/11.1; 604/73, 27, 77

[56] References Cited

U.S. PATENT DOCUMENTS 2,698,996 1/1955 Hickerson ..... 222/192
5,078,734 1/1992 Noble ..... 606/234
5,123,915 6/1992 Miller et al. ..... 606/234
5,176,705 1/1993 Noble ..... 606/234

*Primary Examiner*—Tamara L. Graysay
*Attorney, Agent, or Firm*—Bacon & Thomas

[57] ABSTRACT

The invention refers to a comfort nipple for delivering medicine to a baby and for pacifying a baby in times of distress. The comfort nipple includes a hollow nipple having a barrel-shaped receptacle for holding a dosage of medicine. A shank is used to advance a plunger through the receptacle to deliver a dosage of medicine into the baby's mouth. The plunger may be removed and a stopper may be put in its place to prevent medicine from escaping the receptacle.

6 Claims, 4 Drawing Sheets

BI-FUNCTIONAL COMFORT NIPPLE

BACKGROUND OF THE INVENTION

Based on clinical studies, it has been reported that babies would develop furor and fear soon after birth or in the first few years after birth because of leaving the cozy womb to a strange and muddling environment. Once in a while, they become agitated and too sensitive. Therefore, their parents have to be extremely patient and indulgent to calm them down. Many parents provide their annoying babies with 10 comfort nipples to make them appeased. There is no doubt that the comfort nipple plays a significant role in comforting babies. In addition, to feed babies medicines always is a nightmare for most parents.

To solve these troubles the bi-functional comfort nipple is invented. With its simple configuration, the invention performs two functions as a comfort nipple and medicine feeder.

The bi-functional comfort nipple is composed of a nipple and a shank. A precise scale is set on the surface of the nipple. In the front of the shank is a plunger well fit to the cross section of the hollow barrel in the inside of the nipple. Moving the shank along the scale can push precise dosage of medicine from the barrel into the baby's mouth. The shank can always be kept in its position as a part of the comfort nipple and would not disturb the baby.

SUMMARY OF THE INVENTION

The original invention has both functions of a comfort nipple and a medicine feeder. The inside of nipple is hollowed to a barrel with a semi-open orifice in the front. A movable plunger fit to the barrel is controlled by a shank.

The invention is used as a comfort nipple usually. However, it works as a medicine feeder when there is a need to feed medicines to the baby. The medicine is put in the hollow barrel of the nipple before giving the nipple to the baby. While baby is suckling the nipple as usual, medicine can be delivered smoothly into baby's mouth by moving the level. After the medicine is fed, there is no need to remove the invention from the baby so that the baby would not be disturbed or annoyed.

DESCRIPTION OF THE PREFERRED EMBODIMENT

Figure 1:
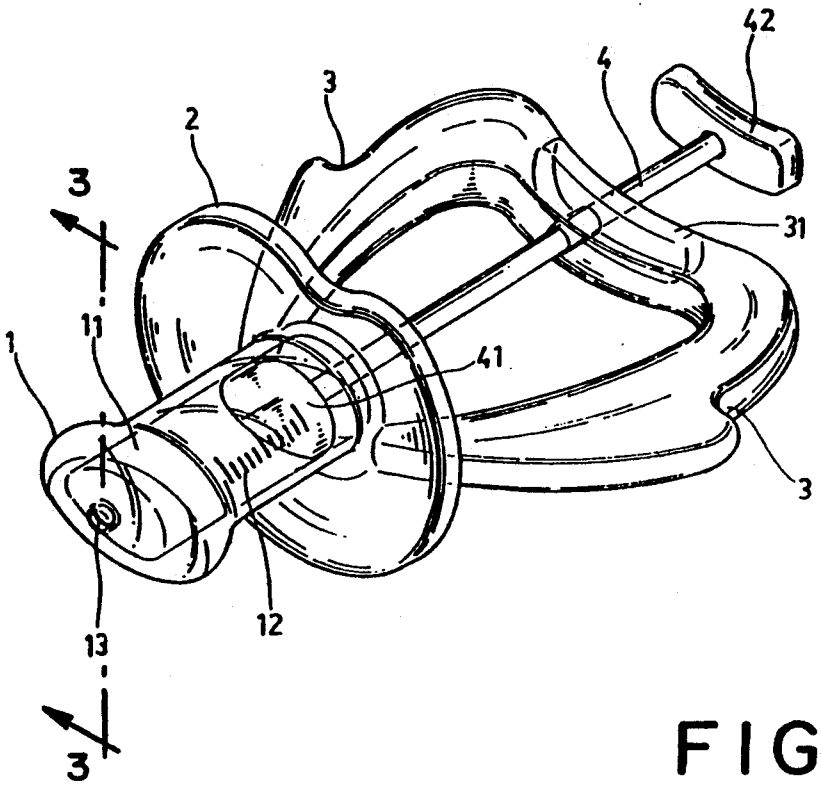
FIG. 1 shows the appearance of the invention in a perspective drawing.
Figure 2:
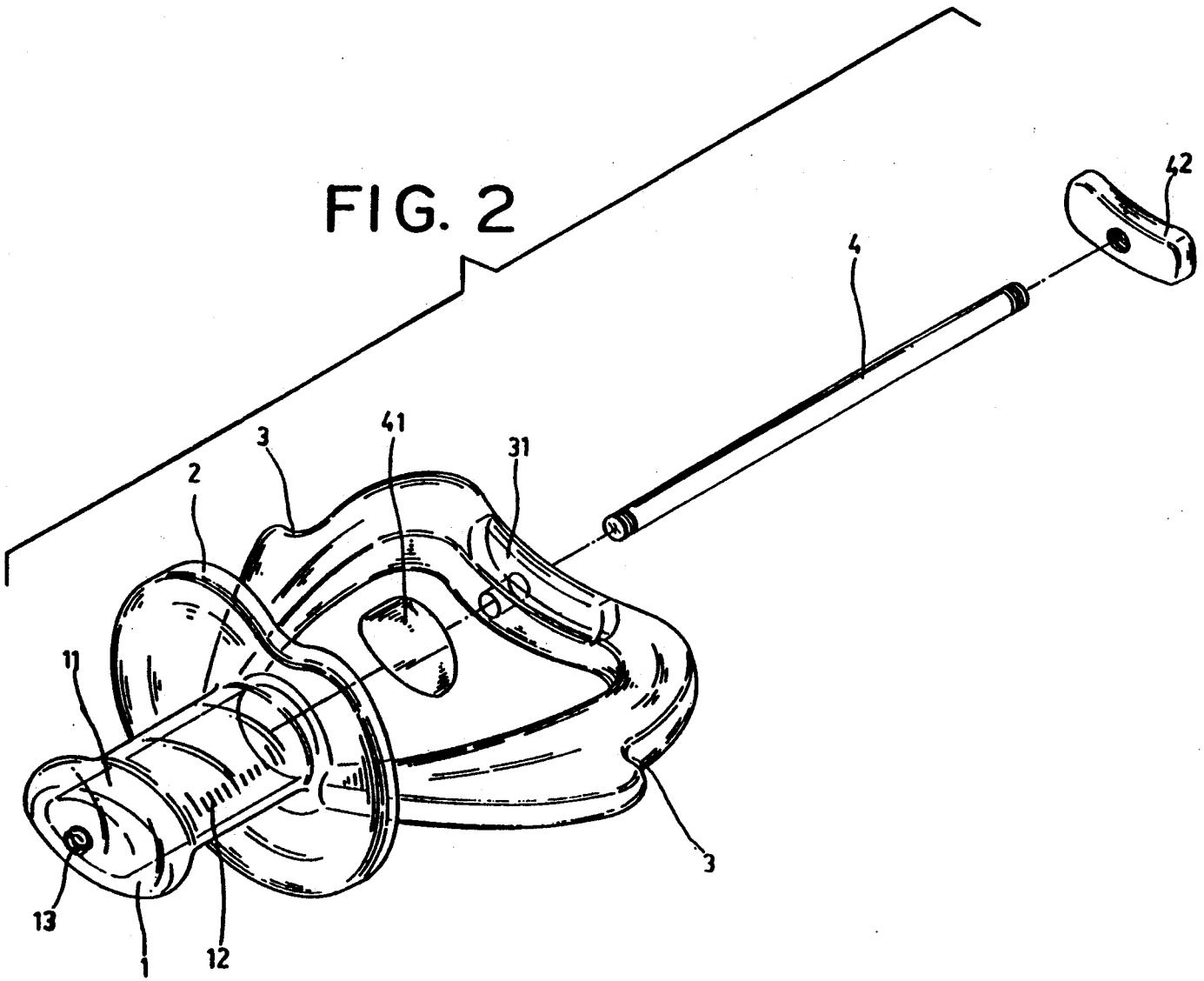
FIG. 2 is an exploded, perspective view showing a plunger-shank-tenon handle arrangement used in accordance with the present invention.
Figure 3:
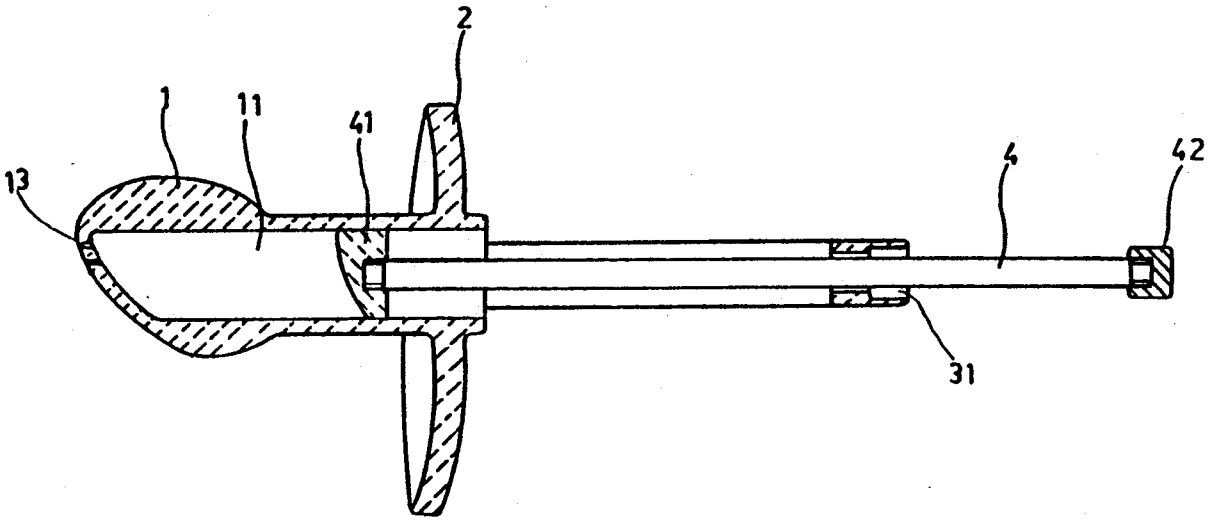
FIG. 3 is the vertical section of the invention.
Figure 4:
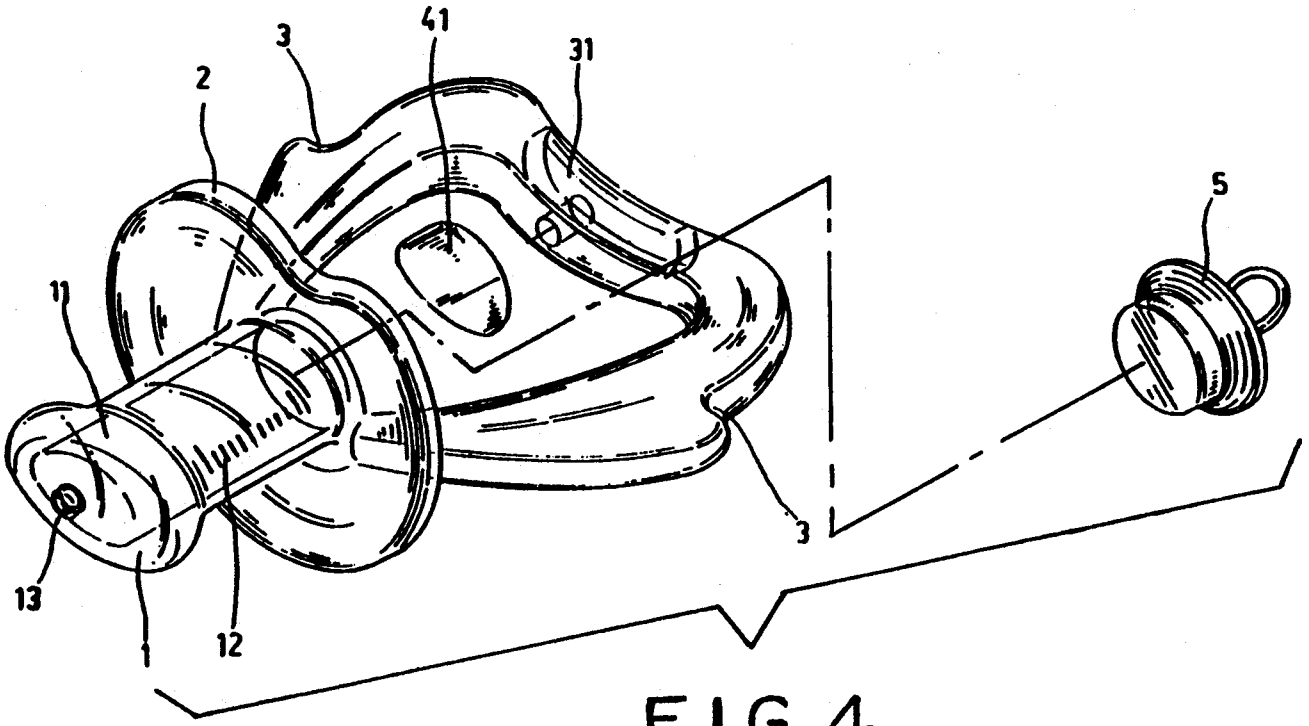
FIG. 4 is an exploded, perspective view showing a stopper used in accordance with the present invention.

Please refer to FIG. 1 and FIG. 2 and FIG. 3 for the structure of the invention. The bi-functional comfort nipple is an original device to perform two functions, one is the function of a comfort nipple and the other is that of a medicine feeder. The invention consists of a nipple (1) and a shank (4). The inside of the nipple (1) is hollowed to a barrel (11) with smooth wall for holding medicine. The rear end of the hollow barrel is located on the back side of the shield (2). As shown in FIG. 4, a precise scale (12) is set on the surface of the nipple for measuring precise dosage of medicine delivered to the baby. A semi-open orifice (13) in the front of the nipple is the front end of the hollow barrel. By pushing the shank, the medicine held in the barrel will be delivered through the orifice to the baby's mouth. A butterfly-shaped thumb ring (3) attaches on the rear side of shield (2) close to the rear opening of hollow barrel (11) which holds the medicine. The user may firmly hold the nipple by inserting a thumb into the ring. A mortise (31) is set in the ring opposite the opening of the barrel. A straight shank (4) with proper length is inserted into the hole in the mortise to connect with the plunger at its front end and with a tenon handle (42) at its rear end. The diameter of the plunger (41) is exactly the same as the diameter of the hollow barrel (11) inside the nipple. As a result, medicine shall be completely delivered into the baby's mouth by pushing the shank forward. No medicine is left in the barrel. A tenon handle is designed at the end of the shank with a shape exactly meeting with that of the mortise (31) in the ring. The tenon handle helps the movement of the shank (4). When the shank is pushed to the end, the tenon handle sets into the mortise perfectly to make a smooth surface in the ring. A separate stopper (5), an attached accessory, replaces the shank to close the rear opening of the hollow barrel (11) when the shank is taken away. The stopper keeps not only the barrel from dirts or polluted air but also the baby from sucking air. The invention is made of an edible soft or semi-soft mastics free from any hazardous substance. The invention serves as a comfort nipple as well as a medicine feeder at the same time. Usually it is used as a comfort nipple. After the baby gets used to the nipple (1), it may be used as a medicine feeder to save the trouble of replacing other apparatus to give medicine to the baby. It is easy to fill medicine by pulling out the shank (4). The dosage of medicine delivered into baby's mouth is controlled precisely by pushing the shank which moves the plunger along the scale. The length of the nipple can help the medicine delivered into the further part of the baby's mouth to prevent the baby from the bitter taste of the medicine. It is not necessary to take out the nipple after medicine feeding. It may be left for baby sucking or may be taken out for cleaning. When it is taken out for cleaning, the shank may be replaced with a stopper (5) to cease the fir flowing through the nipple. The nipple is an invention with double functions.

I claim:

1. A comfort nipple for delivering liquid medicine to a baby and for pacifying a baby in times of distress, the comfort nipple comprising:

a hollow nipple having a feeding outlet means located at a distal end and a barrel-shaped receptacle for holding liquid medicine;

a dosage scale on said nipple for measuring a dosage of medicine to be delivered to the baby;

a shield on a proximal end of the nipple having an opening in communication with the receptacle in said nipple;

a ring attached to the shield at a position adjacent the shield opening, said ring defining a mortise and a guide hole located opposite to the shield opening;

a shank inserted through the guide hole and said mortise, said shank having a first end attached to a tenon handle and a second end attached to a plunger disposed in said receptacle, said plunger being advanced through the receptacle by the shank when pressure is applied to the tenon handle for delivering the dosage of medicine to the baby's mouth through said feeding outlet means; and wherein said tenon handle fits into the mortise upon delivery to enable the plunger to fully extend into the receptacle to ensure that no medicine is left in the receptacle.

2. A comfort nipple as specified in claim 1, further comprising a stopper adapted to fit into the opening in the shield when the plunger is removed from the receptacle to prevent medicine from escaping the receptacle.

3. A comfort nipple as specified in claim 1, where said feeding outlet means is a semi-open orifice.

4. A comfort nipple as specified in claim 1, wherein said ring is a butterfly-shaped thumb ring.

5. A comfort nipple as specified in claim 1, wherein said nipple is made from edible soft mastics.

6. A comfort nipple as specified in claim 1, wherein said nipple is made from edible semi-soft mastics.

* * * * *